US009616265B2

(12) United States Patent
Johnson

(10) Patent No.: US 9,616,265 B2
(45) Date of Patent: Apr. 11, 2017

(54) PADDED POLE VAULT BOX WITH CURVED STOP BOARD

(71) Applicant: Jan E. Johnson, Atascadero, CA (US)

(72) Inventor: Jan E. Johnson, Atascadero, CA (US)

( * ) Notice: Subject to any disclaimer, the term of this patent is extended or adjusted under 35 U.S.C. 154(b) by 209 days.

(21) Appl. No.: 14/489,440

(22) Filed: Sep. 17, 2014

(65) Prior Publication Data

US 2015/0080185 A1 Mar. 19, 2015

Related U.S. Application Data

(60) Provisional application No. 61/880,105, filed on Sep. 19, 2013.

(51) Int. Cl.

| | |
|---|---|
| ***A63B 21/00*** | (2006.01) |
| ***A63B 5/06*** | (2006.01) |
| ***A63B 71/00*** | (2006.01) |

(52) U.S. Cl.

CPC ..... *A63B 5/06* (2013.01); *A63B 71/0054* (2013.01); *A63B 2244/085* (2013.01)

(58) Field of Classification Search

CPC ..... A63B 21/00
USPC ..... 482/14, 23, 15
See application file for complete search history.

(56) References Cited

U.S. PATENT DOCUMENTS

| | | | | |
|---|---|---|---|---|
| 1,168,666 A | | 1/1916 | Medart | |
| 2,110,254 A | * | 3/1938 | Austin | A63B 5/06 482/18 |
| 3,075,765 A | | 1/1963 | Mpakarakes | |
| 3,948,514 A | | 4/1976 | Von Holt | |
| 3,965,507 A | | 6/1976 | Reiland | |
| 4,057,245 A | | 11/1977 | Gordon | |
| 4,163,551 A | | 8/1979 | Simpson | |
| D257,866 S | | 1/1981 | Simpson | |
| 4,442,009 A | * | 4/1984 | O'Leary | C02F 5/125 210/697 |
| 4,468,024 A | | 8/1984 | Johnston | |

(Continued)

FOREIGN PATENT DOCUMENTS

| | | |
|---|---|---|
| FR | 2 594 343 | 8/1987 |

OTHER PUBLICATIONS

Skydex Soft Pole Vault Box, Everything Track & Field website, http://www.everythingtrackandfield.com, retrieved Sep. 4, 2014, 1 page.

(Continued)

*Primary Examiner* — Jerome w Donnelly
(74) *Attorney, Agent, or Firm* — Richard C. Litman

(57) ABSTRACT

A pole vault box with a base pan having opposite front and rear edges, a pole slide, and opposing sidewalls. The pole slide descends downwardly and the sidewalls extend upwardly from the pole slide at an angle from a horizontal axis. A lip extends inwardly towards the pole slide at an angle formed by an axis passing through the lip and by the pole slide in a downward direction. An end plate at the rear edge includes a rotational ledge and a stop board, the rotational ledge is in conjunction with the pole slide and the stop board is in conjunction with the opposing sidewalls and rear edge. The stop board includes lower and upper regions, the upper region curving away from the lower region and the lower region is at an angle outwardly from the rotational ledge. In embodiments, padding can cover one or more surfaces of the box.

23 Claims, 10 Drawing Sheets

(56) References Cited

U.S. PATENT DOCUMENTS

| | | | | |
|---|---|---|---|---|
| 6,029,962 | A | 2/2000 | Shorten et al. | |
| 8,444,531 | B1 * | 5/2013 | Johnson | A63B 5/06 482/14 |
| 2004/0053747 | A1 | 3/2004 | Bollinger | |
| 2004/0067820 | A1 | 4/2004 | Noble et al. | |

OTHER PUBLICATIONS

Skydex Soft Pole Vault Box, Everything Track & Field website, http://www.everythingtrackandfield.com/detail.aspx__Q__ID__E3639__A__CategoryID__E__167, retrieved 2011, 2 pages.

"The Lompoc Vaulting Pit Upgrade Story," SkyJumpers.com, http://www.vstraining.com, retrieved Sep. 12, 2014, 5 pages.

"Pole Vault Safety-Community-Community Page about Pole Vaulting" Pole Vault Safety, Facebook, https://www.facebook.com/pages/Pole-Vault-Safety, retrieved Sep. 12, 2014, 11 pages.

"Jan Johnson's Pole Vault Safety and Technique News letter #12", Apr. 1, 2013, 5 pages.

Boden et el., "Catastrophic Injuries in Pole Vaulters, A Prospective 9-Year Follow-up Study", The American Journal of Sports Medicine, vol. 40, No. 7, 2012 pp. 1488-1494.

"Standard Specification for Pole Vault Box Collars", ASTM International Designation: F2949-12, Oct. 2012, pp. 1-5.

"VS Athletics Track & Field 2014", 2014 Track Catalog, Dura Soft Vault Box, VSAthletics.com, https://www.vsathletics.com/store/Catalog.html, catalog cover pages and pp. 40-41, retrieved Sep. 17, 2014.

* cited by examiner

PADDED POLE VAULT BOX WITH CURVED STOP BOARD

CROSS-REFERENCE TO RELATED APPLICATION

This application claims the benefit of priority under 35 USC §119 of U.S. Provisional Patent Application No. 61/880,105, filed Sep. 19, 2013 in the U.S. Patent and Trademark Office, incorporated by reference herein in its entirety.

BACKGROUND OF THE INVENTION

1. Field of the Invention

The present invention relates to track and field athletics, and particularly to a pole vault box for pole vaulting.

2. Description of the Related Art

Pole vaulting is an ancient pastime steeped in deep tradition. While its exact origins remain unclear, depictions from the Ancient Greeks date as far back as the Fifth Century (B.C.). Since its inclusion in the first modern Olympics, pole vaulting has only continued to grow in popularity. High schools and colleges have driven the popularity, allowing students to earn college scholarships and pursue professional careers.

While pole vaulting may be popular, according to studies in an article in The American Journal of Sports Medicine, pole vaulting has a relatively high risk of direct catastrophic injuries in track and field athletics. Catastrophic Injuries in Pole Vaulters: A Prospective 9-year Follow-up Study, Boden et al., The American Journal of Sports Medicine, Vol. 40, No. 7, 1488-1494, 1488 (July 2012). The article defined "catastrophic injuries" as injuries covering brain hemorrhaging, skull, spine, or pelvic fractures, substantial pulmonary injuries, or intra-abdominal injuries. Id at 1488-1489. During the years 2003 to 2011, 19 catastrophic pole vaulting injuries were acknowledged. Id. at 1490. The majority of these 19 catastrophic injuries occurred by the athlete landing within or in close proximity to the pole vault box, regardless of the presence of a padded collar surrounding the pole vault box or not. Id. at 1492.

In 2003, the National Federation of State High School Associations (NFHS) and the National Collegiate Athletic Association (NCAA) implemented changes to reduce the amount of pole vaulting injuries. It is believed that the most important change implemented by the NFHS and NCAA was increasing the size of the minimum landing pad from 16 feet (ft)×14 ft to 19 ft 8 inches×16 ft 5 inches. Id. Additionally, further safety measures were adopted by organizations, including requiring an athlete to wear a protective helmet. However, as noted by the authors, a helmet may not provide adequate protection for an athlete who falls from a typical pole vaulting height of three meters or more onto a hard surface, such as the hard surface of a pole vault box. Id.

While catastrophic injuries resulting from athletes missing the landing pad have decreased since the safety measures implemented by the NFHS and NCAA have taken affect, injuries resulting from athletes falling into the pole vault box itself have more than tripled from 2003 to 2011. Id. at 1493. For example, some reasons for an athlete incorrectly landing in or near the vault box include premature pole release, lack of momentum, and, in at least one documented instance, the vaulting pole of the athlete catching the front lip of the pole vault box during the pole planting stage. Id. at 1491.

In a second more recent survey taken from data at a pole vaulting camp, 422 respondents, about 90% of the 467 participants, indicated they had incorrectly landed in the pole vault box area one or more times. 2012 Pole Vault Survey Results and Data Interpretation, Johnson et al., Sky Jumpers Vertical Sports Club, 1-4 (2012).

While addressing some safety concerns, present pole vault boxes may not address other safety concerns of pole vaulting. One safety concern relates to present pole vault boxes having a straight linear stop board at the end of the pole slide. A potential danger of having a straight linear stop board occurs when the vaulter is already in flight and the pole is bending. The bending pole could collide with the straight stop board, which can result in a damaged vaulting pole. For example, if the vaulting pole weakens or breaks while the vaulter is in mid-flight, the vaulter could potentially fall straight down into the pole vault box from a considerable height. A second safety concern involving the stop board stems from the angle between the stop board and the rotational ledge, which may contribute to the vaulting pole smacking into the lower region of the stop board.

Another possible issue with present pole vault boxes can arise from the lip located in front of the pole slide. Many pole vault boxes have a thick lip that sticks out in front of the pole slide above the surface of a runway that the runner is traveling down prior to planting the vaulting pole. A possible danger with such lip, since it protrudes out above the ground, is the tip of the vaulting pole catching the lip prior to the vaulter planting the vaulting pole. If the vaulting pole tip were to catch with the lip, the pole vaulter may fall down or perform an improper plant, as well as the vaulting pole may weaken or break from the collision with the front lip.

Finally, present pole vault boxes include those that provide no padding on the box itself, or if padding is present, the padding exists only in certain areas. It has been recorded that a direct fall onto an area of the pole vault box that does not have padding, including falling onto a pole slide area or a sidewall, can measure up to about 10,000 Head Injury Criteria (HIC). HIC is a special unit of measurement that provides a likelihood of a head injury arising from an impact. In comparison, at an HIC value of 1000, about one in six people may suffer a life-threatening injury to their brain and, at an HIC value of 250, athletes may suffer a concussion, for example. If the present day pole vault box does have padding, it generally has padding underneath the pole slide or possibly on the sidewalls. However, in present pole vault boxes, areas such as underneath the lip, underneath the rotational ledge, or behind the stop board remain without padding.

It is desirable that a pole vault box has a non-linear stop board portion to limit incorrect collisions with a bending vaulting pole as a vaulter is in flight. It is further desirable, that a pole vault box have a relatively more obtuse or increased angle between the rotational ledge and the stop board, and it is desirable that a lip in front of the pole slide of the pole vault box is structured to minimize catching the tip of the vaulting pole as the vaulter is planting the vaulting pole, and that the lip is adaptable for insertion into the runway. It is also desirable that padding is present on all or portions of surfaces of the lip, rotational ledge, and stop board. Additionally, the padding can extend above the sidewall and/or one or more portions of the base pan.

Thus a padded pole vault box with curved stop board addressing the aforementioned problems is desired.

SUMMARY OF THE INVENTION

Embodiments of a padded pole vault box with curved stop board are provided to enhance athlete safety. The pole vault box has a base pan with a front edge and a rear edge that are in opposing relation to one another and also has a pole slide, the pole slide descending in a downward direction from the front edge towards the opposing rear edge. The base pan includes a plurality of opposing sidewalls that extend from the front edge to the opposing rear edge in an upward direction from the pole slide. Each sidewall of the plurality of opposing sidewalls extends at an angle with respect to a horizontal axis that is in horizontal relation with respect to the pole slide.

A lip is positioned at the front edge of the base pan and extends inwardly towards the pole slide in a downward direction away from the front edge of the base pan. The lip slopes inwardly towards the pole slide at an angle that is formed by an axis passing through the lip and by the pole slide. The lip is adaptable to be inserted into a runway and can be recessed below the runway, and can have an adhesive on a surface of the lip adjacent to the runway to provide further anchoring of the lip below or at the runway surface.

An end plate is positioned at the rear edge of the base pan and includes a robust rotational ledge and a sturdy stop board. The rotational ledge is positioned in conjunction with the pole slide of the base pan, and the stop board is positioned in conjunction with the opposing sidewalls of the base pan and the rear edge of the base pan. The pole slide and/or the sidewalls can also be constructed to be more flexible than conventional pole vault boxes so as to readily deform when impacted by a falling object or body.

The stop board includes a lower region adjacent to the rotational ledge and an upper region adjacent to the lower region of the stop board. The upper region of the stop board curves away from the lower region of the stop board, and the lower region of the stop board is positioned at an angle so as to extend outwardly in relation to the rotational ledge of the end plate.

In embodiments of a pole vault box, a padded material is provided that covers at least one of a portion of an exterior surface of the base pan, a portion of a surface of the lip, and/or a portion of an exterior surface of the end plate and sidewalls.

Also, in embodiments of a pole vault box, the pole vault box can have retro pieces as additions to a pole vault box. A first retro piece can be applied to the stop board, such as to increase the angle between the rotational ledge and the stop board. A first retro piece can also be added to replace an existing stop board, such as a worn or damaged stop board. Further, the first retro piece can have a padded material on the underside/exterior surface to provide for additional shock attenuation. A second retro piece having a pole slide, a lip, and a plurality of opposing sidewalls, can be applied to replace an existing, worn or damaged pole slide, lip, and sidewalls of a pole vault box, and can also have a padded material on the underside/exterior surface to provide further shock absorption, such as between the pole slide and the second retro piece. Also, the first retro piece and the second retro piece can be removably securable so as to be combined with each other or to either or both of the stop board or the pole slide, respectively.

These and other features of the present invention will become readily apparent upon further review of the following specification and drawings.

BRIEF DESCRIPTION OF THE DRAWINGS

Unless otherwise indicated, similar reference characters denote corresponding features consistently throughout the attached drawings.

DETAILED DESCRIPTION OF THE PREFERRED EMBODIMENTS

Figure 1:
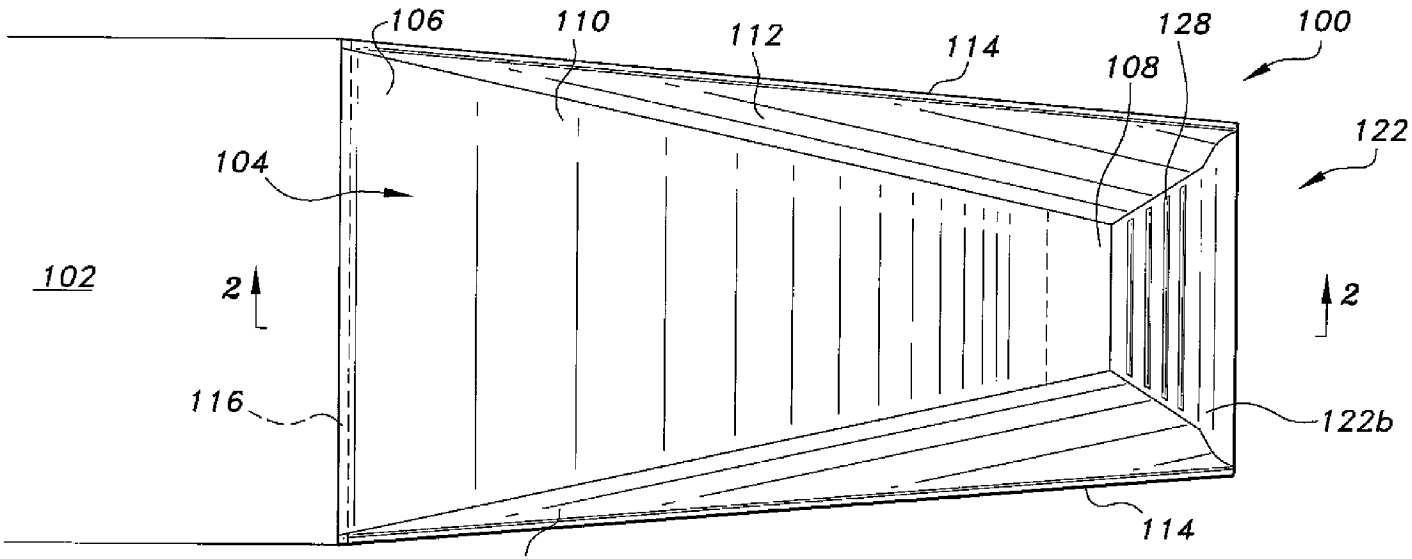
FIG. 1 is a top view of an embodiment of a pole vault box according to the present invention.

Referring to FIGS. 1-5, a pole vault box 100 is shown. Pole vault box 100 can be implemented into many different settings, including an elevated or in-ground platform, soil, or any other common setting used in a pole vault athletic event. At its widest width, it is desirable for pole vault box 100 to be about 60 cm and at its narrowest width it is desirable for the pole vault box 100 to be about 15 cm. However, these dimensions can be changed to suit the needs of the area where the pole vault box 100 will be implemented or the needs of a particular standard, use, or application, for example.

Typically, the pole vault box 100 will be placed in front of a runway 102, which is an area that permits an athlete to run at an appropriate speed to perform a pole vault. Runway 102 can be made from a number of different materials, including dirt, grass, concrete, and artificial turf, among others. It is desirable that runway 102, or at least a portion of the runway 102 surrounding the pole vault box 100, be made from a softer material, such as plush grass, as may assist in protecting an athlete that has fallen onto the runway surface 102. Further, pole vault box 100 is configured to be implementable with other pole vaulting safety equipment, including padded box collars or landing pads such as disclosed in U.S. Pat. No. 3,965,507, for example, among other equipment.

Pole vault box 100 includes a base pan 104 having a front edge 106 and a rear edge 108. The base pan 104 can also include a pole slide 110, and the pole slide 110 descends in a downward direction from the front edge 106 to the rear edge 108 of the base pan 104. The pole slide 110 is an area that interacts with the vaulting pole as the athlete is performing a plant. As the athlete runs down a runway surface 102, the athlete will begin to shift the position of the vaulting pole from a horizontal orientation to a somewhat vertical orientation by bringing the tip of the vaulting pole down onto and across the downward descending pole slide 110.

The length of the pole slide 110 can vary depending on a particular standard, use, or application. However, the length of a typical pole slide 110 is generally about 100 cm, for example. Since the pole vault box 100 is placed in front of the runway 102, the front edge 106 of the base pan 104 will be near or below the surface of the runway 102, while the rear edge 108 of the base pan 104 as well as a stop board 122 will be below the surface of the runway 102. The depth that the rear edge 108 descends below the surface of runway 102 is at a depth of generally about 20 cm. However, the depth that the rear edge 108 descends below the surface of runway 102 can be adjusted to any appropriate level for a particular standard, use or application, for example.

Figure 3:
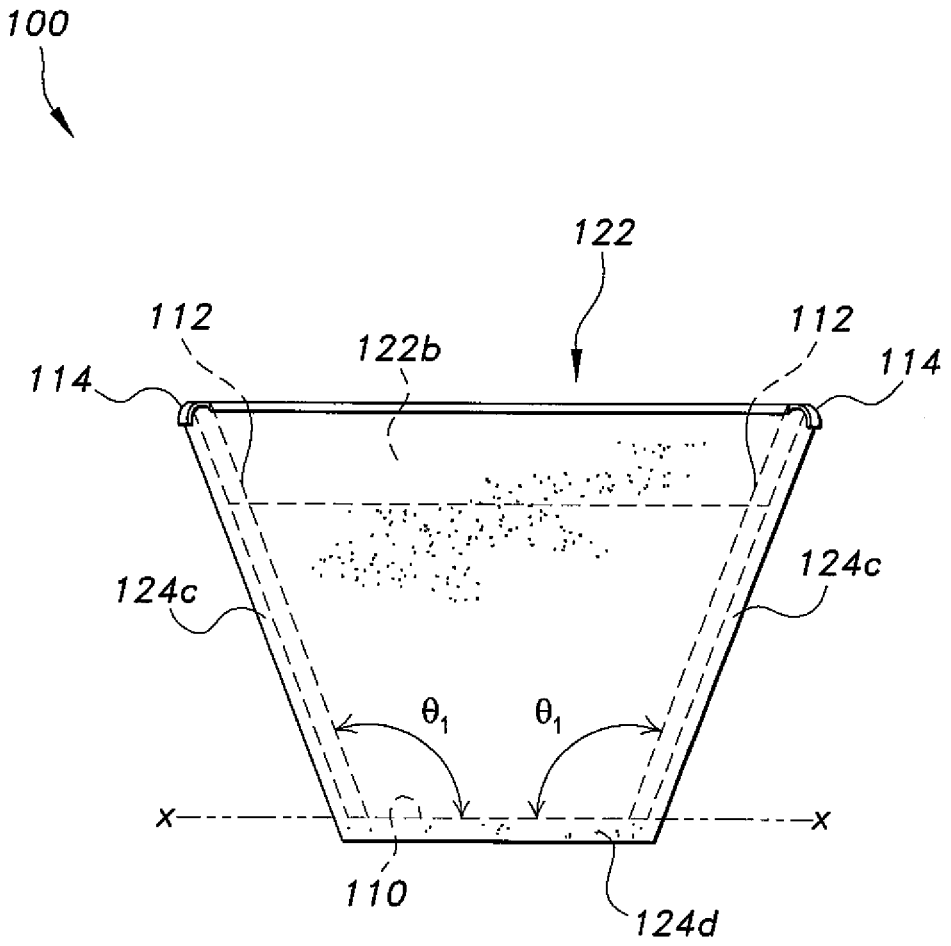
FIG. 3 is a rear view of the embodiment of a pole vault box of FIG. 1 according to the present invention.
Figure 4:
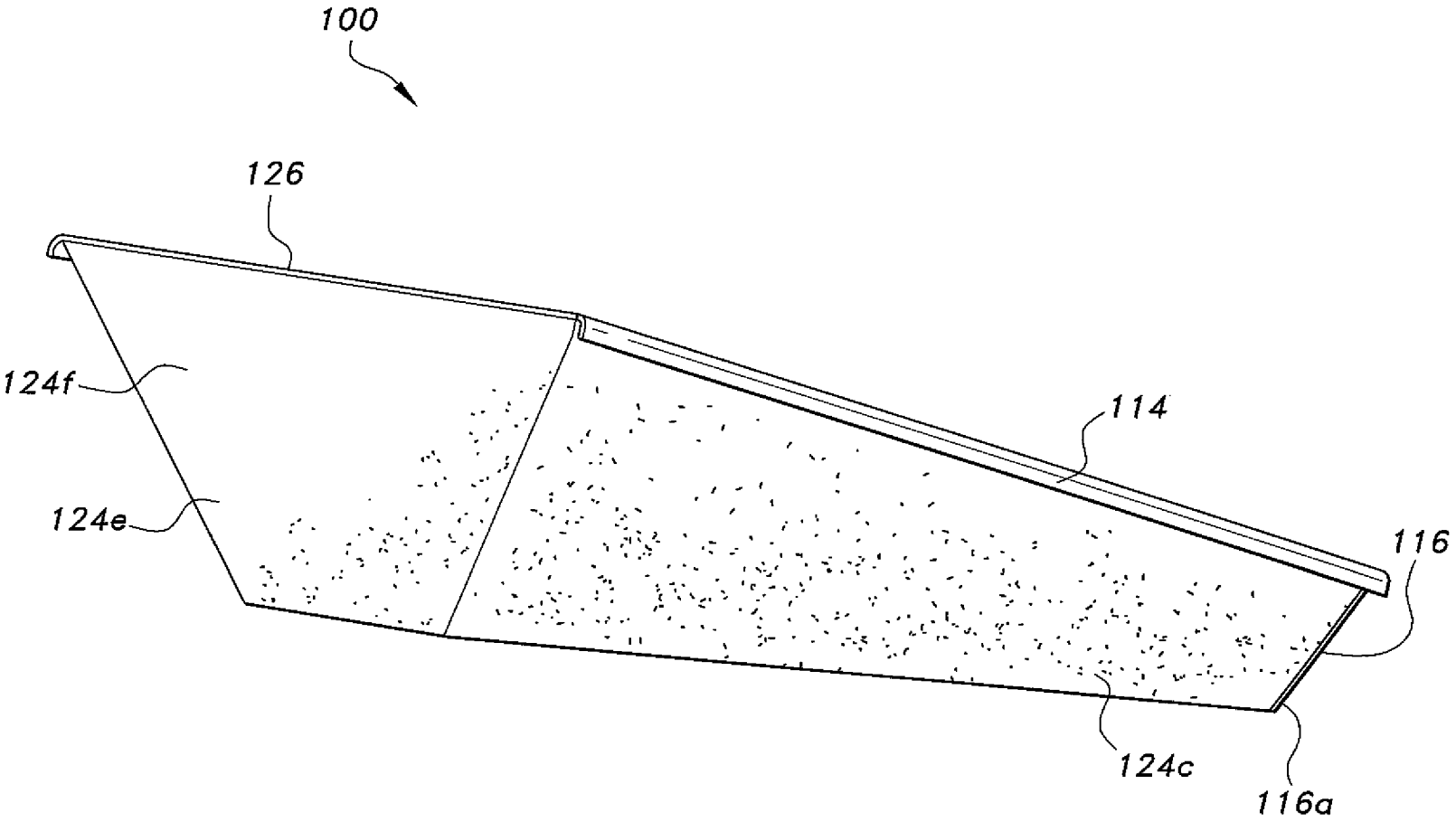
FIG. 4 is a rear perspective view of the embodiment of a pole vault box of FIG. 1 according to the present invention.
Figure 5:
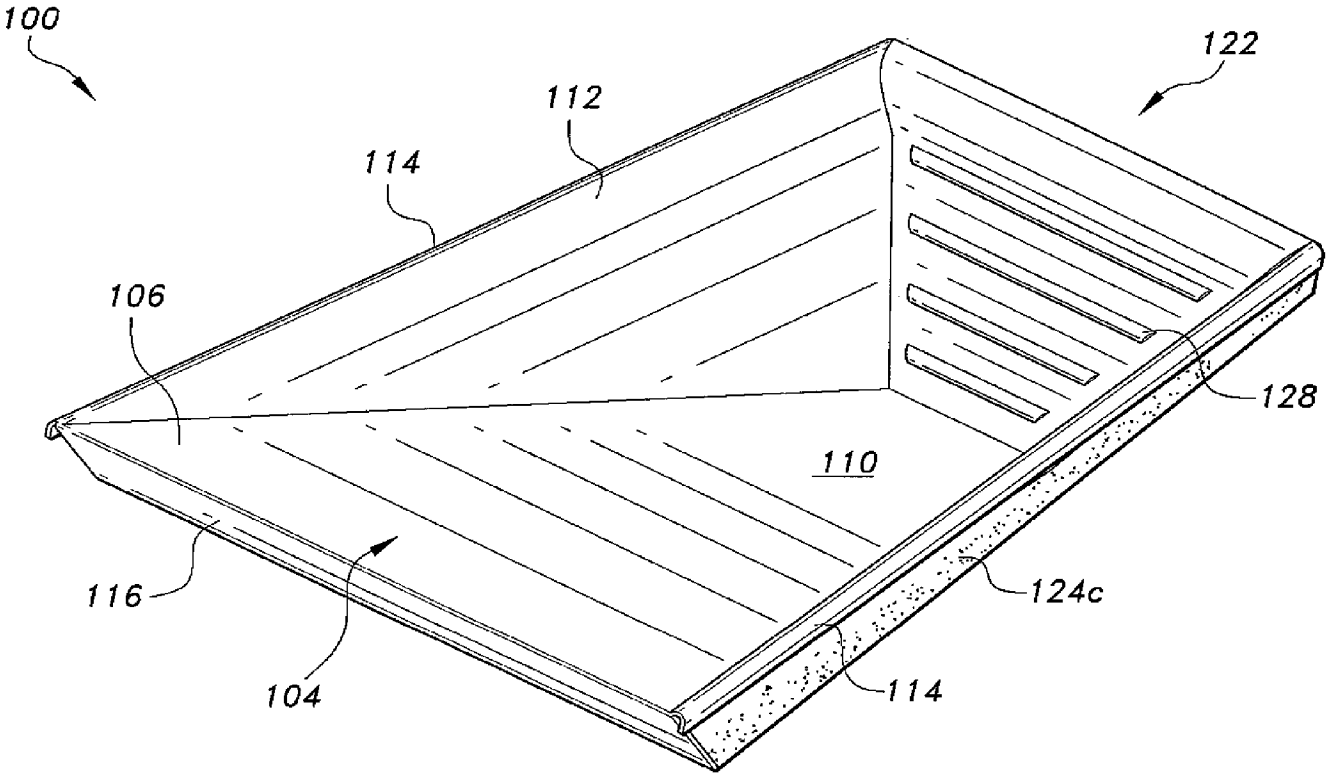
FIG. 5 is a perspective view of the embodiment of a pole vault box of FIG. 1 according to the present invention.

The base pan 104 is desirably rigid to maintain the desired shape yet flexible so as to deform in response to an impact force. The base pan 104 includes a plurality of opposing sidewalls 112 that extend from the front edge 106 of the base pan 104 to the rear edge 108 of the base pan 104. The plurality of opposing sidewalls 112 extend from the pole slide 110 in an upward direction and extend out at an angle $\theta_1$ with respect to a horizontal axis x that is in a horizontal relation with respect to the pole slide 110, the angle $\theta_1$ being measured from the x axis along an interior surface of the pole slide 110 to an interior surface of a corresponding sidewall 112, such as illustrated in FIG. 3. It is desirable that the value of $\theta_1$ be about 120°.

However, the angle $\theta_1$ can be adjusted to any suitable value, as long as the plurality of opposing sidewalls 112 do not interfere with the planting of the vaulting pole in the pole vault box 100 and the angle $\theta_1$ meets a corresponding standard, use or application. Each sidewall 112 of the plurality of opposing sidewalls 112 can have a flared end 114, for example. The flared end 114 can take a rounded shape, or any other shape that would provide a contoured edge. The flared end 114 can enhance safety during pole vaulting, in that a flared edge 114 of the sidewall 112 can assist in further protecting an athlete, such as if the athlete were to directly land onto the sidewall 112.

The base pan 104, including pole slide 110 and the plurality of opposing sidewalls 112, can be made from a number of different materials, including wood, welded sheet steel, galvanized steel, stainless steel, sheet or cast aluminum, fiberglass, or thermoplastic, among others, for example. As an example, the sidewalls 112 can be made from a 16 gauge to a 20 gauge steel material. If thermoplastic is selected for the material to be used, the thermoplastic can be polyethylene, polyurethane, acetyl, nylon, or any other commonly used thermoplastic material. It should be noted that whatever material is selected for the base pan 104 or the pole slide 110 or the plurality of opposing sidewalls 112, that the material be sufficiently rigid and robust enough to withstand the force generated from the vaulting pole striking and sliding down the pole vault box 100 yet flexible so as to absorb the impacts to a degree.

It is also desirable that a softer material, such as a thermoplastic or lightweight sheet metal, be used to provide a more pliable, resilient, or flexible surface, as opposed to a heavyweight plate steel, if the vaulter does fall incorrectly and come into contact with the base pan 104 or the pole slide 110 or one or more sidewalls 112. By using a softer or flexible material, the base pan 104 or the pole slide 110 or the plurality of opposing sidewalls 112 can have more of a softer or resilient yet structurally sound construction.

Figure 2:
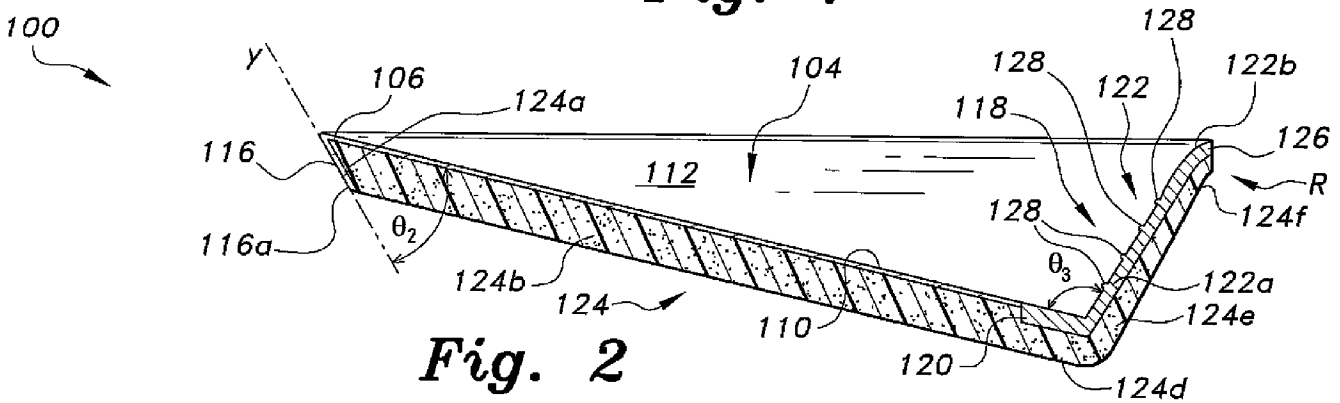
FIG. 2 is a cross-sectional view of the embodiment of a pole vault box taken along the line 2-2 of FIG. 1 according to the present invention.

Continuing with reference to FIGS. 1-5, positioned at the front edge 106 of the base pan 104 is a lip 116. The pole slide 110 can also include the lip 116. The lip 116 slopes inwardly towards the pole slide 110 in a downward direction away from the front edge 106 of the base pan 104. This construction improves structural stability yet allows ample space for flexible or resilient connection to the runway underlayer. The lip slopes inwardly at an angle $\theta_2$ that is formed by an axis y passing through the lip 116 and by the pole slide 110, as illustrated in FIG. 2.

The value of the angle $\theta_2$ can be any value less than 90° in order to minimize the lip 116 possibly interfering with the vaulting pole during the pole planting stage. It is desirable that the value of $\theta_2$ be in the range of about 70° to about 80°, for example. Further, the lip 116 is adapted for positioning at, into and below the surface of the runway 102, as illustrated in FIG. 1, for example. By inserting the outer lower edge 116*a* of the lip 116 into the runway 102, the outer lower edge 116*a* of the lip 116 will not be exposed onto the surface of the runway 102, thereby possibly reducing a risk of the tip of the vaulting pole catching against the outer lower edge 116*a* of the lip 116 as the vaulter is planting the vaulting pole. Further, by inserting the outer lower edge 116*a* of the lip 116 into the runway 102, pole vault box 100 can provide a flexible connection to the runway 102. It is desirable that the lip 116 be recessed below the runway 102 at a minimum depth of about 0.50 inches so as to reduce the possibility of the lip 116 blocking a vaulting pole from correctly entering the front of the pole vault box 100 or the pole slide 110, such as illustrated in FIG. 1.

Therefore, it is desirable that the outer lower edge 116*a* of the lip 116 be recessed below the surface of the runway 102 at a depth of about 0.5 inch to about 1 inch, for example. Further, the lip 116 can have an adhesive, such as a suitable glue, epoxy or other fastening material, on a surface of the lip adjacent to the runway, such as can provide a glue edge lip or a glue down lip, for example, to assist in anchoring the lip 116 at, into or below the runway 102, for example. Finally, the lip 116 can be made from a number of different materials, including wood, welded sheet steel, stainless steel, sheet or cast aluminum, fiberglass, or thermoplastic, among others, for example.

The base pan 104 also includes an end plate 118 positioned at the rear edge 108 of the base pan 104. The end plate 118 is formed as a single or unitary piece, such as being integrally formed or as by a combination of a plurality of pieces suitably combined. The end plate 118 can be made from a number of suitable materials, including steel, concrete, fiberglass, or high density plastic, among others, for example. The end plate 118 is desirably constructed from a relatively stiffer material compared to the relatively flexible material used to form the base pan 104 or at least the sidewalls 112 of the base pan 104, since the end plate 118 experiences a substantial amount of impacts during normal use. Thus, the end plate 118 should be relatively stiffer, robust and structurally sound in order to accommodate such impact forces. The end plate 118 includes a rotational ledge 120 and a sturdy stop board 122.

For example, the rotational ledge 120 and the stop board 122 can be formed as a single end plate 118 out of durable and rigid material. By using a rigid and durable material for the stop board 122, the life of the stop board 122 can be prolonged, since the stop board 122 is frequently exposed to forces generated by the high impact of the tip of the vaulting pole. Further, end plate 118 can be removably securable to the base pan 104, for example, in forming the pole vault box 100.

The rotational ledge 120 of the end plate 118 is in conjunction with the pole slide 110 and, therefore, can be integrally formed or combined with the pole slide 110 so as to be positioned typically at a substantially same level or below the pole slide 110, such as depending on a particular standard, use, or application, for example. Adjacent to the rotational ledge 120 is the stop board 122, which includes a lower region 122*a* and an upper region 122*b*. It is desirable that the lower region 122*a* accounts for about 70% of the total size of stop board 122 and that upper region 122*b* accounts for about the remaining 30% of the total size of the stop board 122. It should be noted that these regions 122*a* and 122*b* can vary in size, such as 60% of the stop board 122 is the lower region 122*a* and 40% of the stop board 122 is the upper region 122*b*, for example, such as depending on a particular standard, use, or application.

The lower region 122*a* of the stop board 122 is positioned at an angle $\theta_3$ so as to extend outwardly in relation to the rotational ledge 120 of the end plate 118, the angle $\theta_3$ being measured between an interior surface of the lower region 122*a* of the stop board 122 and the interior surface of the rotational ledge 120, as illustrated in FIG. 2. The value of the angle $\theta_3$ is in a range of about 105° to about 115°, for example, thereby reducing risks of frictional engagement between the bottom of the bent vaulting pole during the jump and the top of the stop board 122, when the vaulting pole engages the rotational ledge 120.

Also, the lower region 122*a* of stop board 122 of end plate 118 has a relatively straight, generally linear shape. The upper region 122*b* of the stop board 122 is adjacent to the lower region 122*a* and has a shape that curves away from the lower region 122*a*, such as at a radius of curvature R, such as illustrated in FIG. 2. The curvature and the radius of curvature R of the upper region 122*b* can be structured of a suitable shape and suitable radius of curvature R, depending on a particular standard, use or application. The radius of curvature R can be structured to provide for a suitable degree curve of the upper region 122*b*, such as can depend upon a particular standard, use or application, such as a 5 degree curve or curvature, for example. This generally curved shape of the upper region 122*b* of the stop board 122 also can allow for less of a probability of the vaulting pole grinding against the top of the stop board 122, and can also reduce possible damage to the vaulting pole during the pole vault, since the upper region 122*b* is at a greater distance away from the bent vaulting pole.

Conventional pole vault boxes typically have a relatively straight edge or corner at the top of the stop board. If the bottom section of the pole abuts this corner during the jump, this type of action increases the chances of nicks and deterioration from friction occurring at the impact point on the pole. Thus, failure or fracture can occur as can lead to potential injury to the vaulter. By having the stop board 122 in a relatively straight, generally linear orientation in the lower region 122*a* and the stop board 122 including a generally curved orientation for the upper region 122*b*, the stop board 122 assumes a generally curvilinear shape, as illustrated in FIG. 2, for example.

Further, the upper region 122*b* of the stop board 122 can have a flared edge 126. The flared edge 126 can be of various suitable shapes, such as rounded, curved, flat, or any other desirable shape, that can assist in minimizing injury to the pole vaulter, as from an incorrect landing, such as when the pole vaulter falls onto the stop board 122. For additional protection, an interior surface of stop board 122 can have a ribbed surface 128 such as ripples or ridges, on an interior surface of the stop board 122. Ribbed surface 128 can be placed on either the lower region 122*a* or the upper region 122*b* of the stop board 122 or on both regions 122*a* and 122*b*, depending upon a particular standard, use or application, for example. The ribbed surface 128 can allow for friction, against the tip of the vaulting pole, to provide an elevated coefficient of friction, to minimize the occurrence of the vaulting pole incorrectly traveling upward on the stop board 122.

Continuing with reference to FIGS. 1-5, pole vault box 100 can have a padded material 124 added to its various surfaces as a shock absorbing material for shock absorption which can reduce the risk of injury. Padded material 124 can be made from a number of different materials or structures or combinations of materials and/or structures, including, but not limited to, open or closed cell foam, egg shell plastic, rubber, air bladders, gel constructions, metal springs, or resilient loose material such as shredded rubber tires or rubber mulch, for example. The depth, thickness, and amount of cushioning can vary depending on the material selected to be implemented and depending upon a particular standard, use or application, for example. The thickness of the padded material 124 can be on the order of approximately 0.125 inches to approximately 4.00 inches, for example. The padded material 124 can be formed as a single unitary structure or formed of a plurality of pieces. Finally, the padded material 124 can be attached to the appropriate surfaces of the pole vault box 100 by any suitable mechanism or methods, such as including glue, fasteners, and stitching, among others, for example.

Padded material 124 can be arranged and implemented on all components of pole vault box 100 or on selected components or on portions of components of the pole vault box 100, depending on a particular standard, use or application. In the pole vault box 100, the padded material 124 can include various portions or sections of padded material, such as padded material 124*a*-124*f*. For example, the lip 116 can have on an interior surface the padded material 124*a*. Base pan 104 including the pole slide 110 can have on an exterior surface the padded material 124*b*. Each sidewall 112 of the plurality of opposing sidewalls 112 can have on an exterior surface the padded material 124*c*. The end plate 118 can have on an exterior surface of the rotational ledge 120 the padded material 124*d*.

The stop board 122 can have on an exterior surface of the lower region 122*a* the padded material 124*e* and can have on an exterior surface of the upper region 122*b* the padded material 124*f*. Since the stop board 122 has the lower region 122*a* and the upper region 122*b*, the respective padded material 124*e* and 124*f* can be placed on one or more of the exterior surface of the lower region 122*a* and/or the exterior surface of the upper region 122*b*, or on at least a portion of the lower region 122*a* or the upper region 122*b*. Also, in various embodiments, the padded material 124 can be absent from various surfaces or portions thereof of the pole vault box 100, such as discussed in relation to FIG. 8B, for example.

Figure 6:
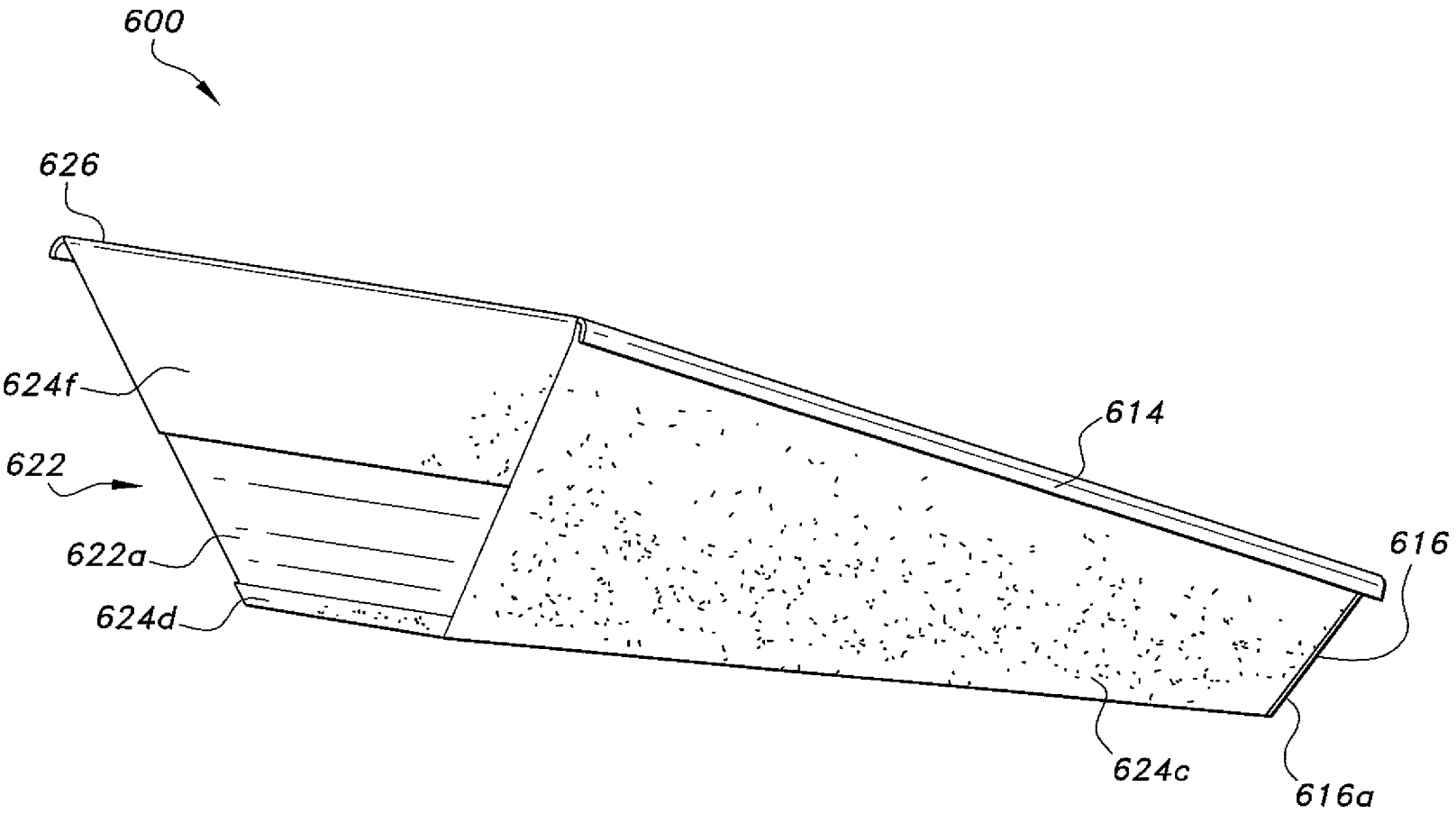
FIG. 6 is a rear perspective view of an embodiment of a pole vault box according to the present invention.
Figure 7:
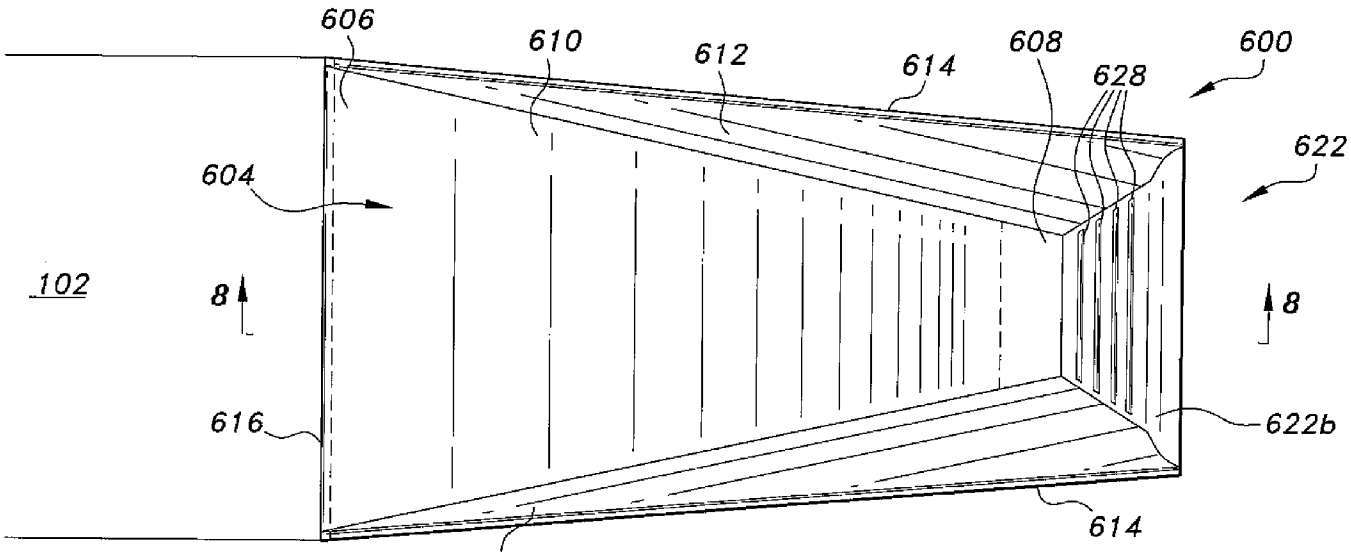
FIG. 7 is a top view of the embodiment of a pole vault box of FIG. 6 according to the present invention.

Referring to FIGS. 6-9, an embodiment of a pole vault box 600 is shown. Pole vault box 600 is similar to the pole vault box 100. However, the pole vault box 600 differs in the amount of padding on a stop board 622 in comparison to the padding on the stop board 122 of pole vault box 100. As illustrated in FIGS. 6 and 8A, pole vault box 600 includes a padded material 624*f*, similar to the padded material 124*f*, on only an upper region 622*b* of the stop board 622. As illustrated in FIG. 8B, the stop board 622 can also not include any padded material 624, for example.

Also, the components included in the pole vault box 600, as discussed and as illustrated in FIGS. 6-9, are similar to and correspond to those included in the pole vault box 100, described or illustrated in FIGS. 1-5, and can have a same or similar structure, shape and function and can be formed of same or similar materials or compositions, as those corresponding components discussed and described with respect to the pole vault box 100.

Also, similar to the pole vault box 100, pole vault box 600 has a base pan 604 with a front edge 606 and a rear edge 608, a pole slide 610 that descends from the front edge 606 to the rear edge 608, and a plurality of opposing sidewalls 612 that extend from the front edge 606 to the rear edge 608. The base pan 604 can also include the pole slide 610. Each sidewall 612 of the plurality of opposing sidewalls 612 can have a flared end 614, for example. It should be noted that whatever material is selected for the base pan 604 or the pole slide 610 or the plurality of opposing sidewalls 612, that the material be sufficiently rigid and robust enough to withstand the force generated from the vaulting pole striking and sliding down the pole vault box 600 yet flexible so as to absorb the impacts to a degree.

In the pole vault box 600, the base pan 604 also includes an end plate 618 positioned at the rear edge 608 and a lip 616 is positioned at the front edge 606. The end plate 618 includes a rotational ledge 620 and a stop board 622 and can be removably securable to base pan 604, for example, in forming the pole vault box 600. The stop board 622 includes a lower region 622*a* and the upper region 622*b*. The lower region 622*a* has a generally linear shape and the upper region 622*b* has a generally curved shape that curves away from the lower region 622*a*. Further, the upper region 622*b* of the stop board 620 can have a flared edge 626. The flared edge 626 can be rounded, curved, flat, or any other desirable shape that can assist in minimizing injury to the pole vaulter, as from an incorrect landing.

Finally, the interior surface of stop board 622 can have a ribbed surface 628, such as ripples or ridges, on an interior surface of the stop board 622. Ribbed surface 628 can be placed on either the lower region 622*a* or the upper region 622*b* of the stop board 622 or on both regions 622*a* and 622*b*, depending upon a particular standard, use or application, for example. The end plate 618 is desirably constructed from a relatively stiffer material compared to the relatively flexible material used to form the base pan 604 or at least the sidewalls 612 of the base pan 604, since the end plate 618 experiences a substantial amount of impacts during normal use. Thus, the end plate 618 should be relatively stiffer, robust and structurally sound in order to accommodate such impact forces.

Also, similar to the pole vault box 100, pole vault box 600 can have the padded material 624 added to its various surfaces, or portions of its surfaces, such as for shock absorption and attenuation which can assist in reducing the risk of injury. In an embodiment of the pole vault box 600, the padded material 624 can include various portions or sections of padded material, such as padded material 624*a*-624*d* and padded material 624*f* on the upper region 622*b* of the stop board 622. Also, padded material 624 can be implemented on various pieces of the pole vault box 600, depending on a particular standard, use or application.

Figure 8A:
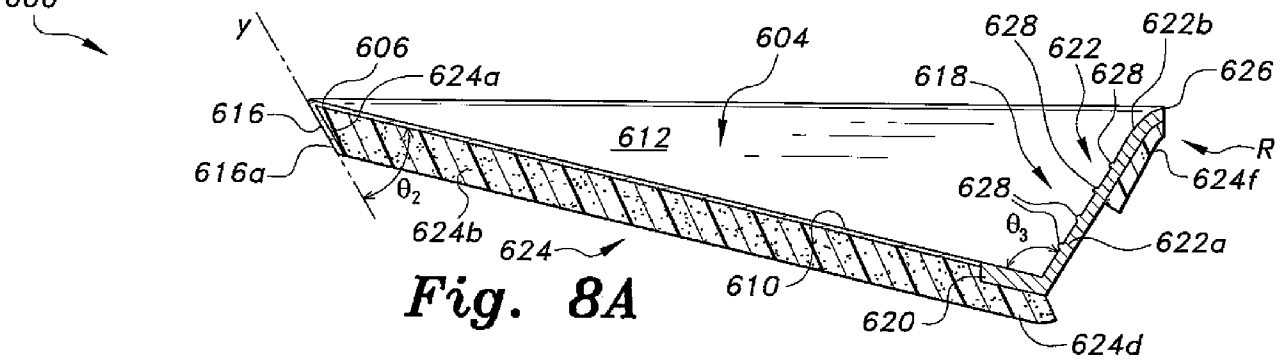
FIG. 8A is a cross-sectional view of the embodiment of a pole vault box of FIG. 6 taken along the line 8-8 of FIG. 7 with padding included on an upper portion of the stop board according to the present invention.
Figure 8B:
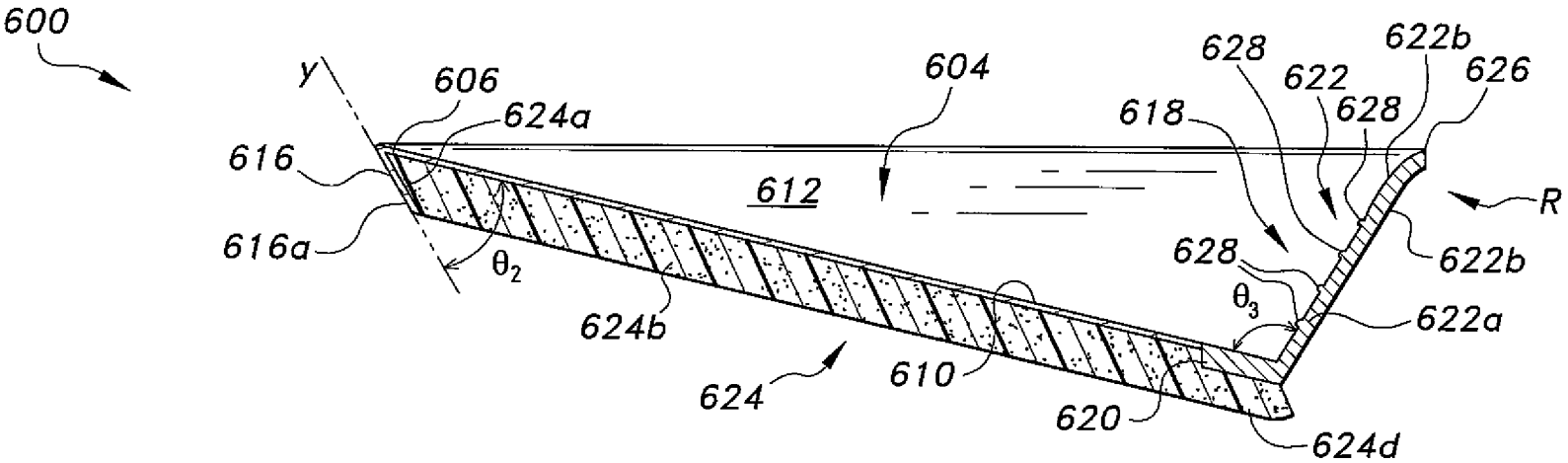
FIG. 8B is a cross-sectional view of the embodiment of a pole vault box of FIG. 6 taken along the line 8-8 of FIG. 7 without padding being included on the stop board according to the present invention.

For example, the lip 616 can have on an interior surface the padded material 624*a*. Base pan 604 including the pole slide 610 can have on an exterior surface the padded material 624*b*. The plurality of opposing sidewalls 612 can have on an exterior surface the padded material 624*c*. Also, the end plate 618 can have on an exterior surface of the rotational ledge 620 the padded material 624*d*. However, as mentioned previously, an embodiment of the pole vault box 600 can either include the padded material 624*f* on the upper region 622*b* of the stop board 622, as illustrated in FIGS. 6 and 8A, or the padded material 624 can be absent from the stop board 622, as illustrated in FIG. 8B, for example.

Figure 9:
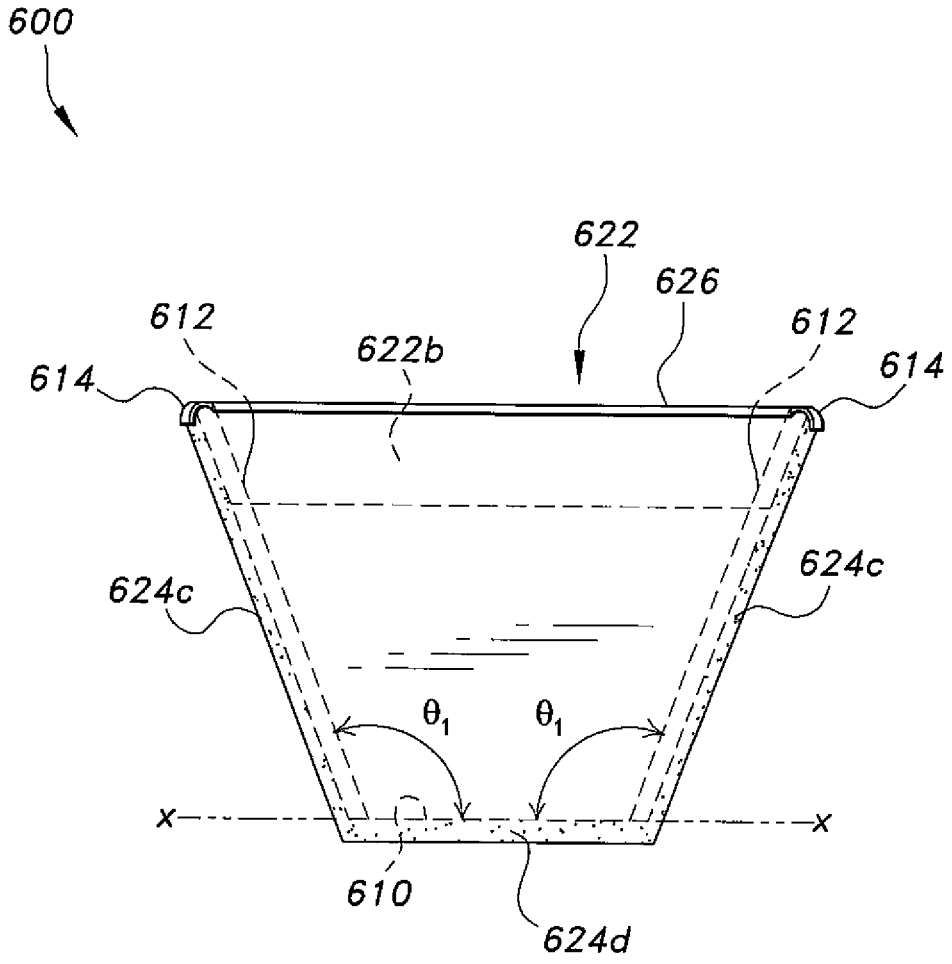
FIG. 9 is a rear view of an embodiment of a pole vault box of FIG. 8B according to the present invention.

Similar to the discussion as to the pole vault box 100, each sidewall 612 of the plurality of opposing sidewalls extends at an angle $\theta_1$ with respect to a horizontal axis x that is in horizontal relation with respect to the pole slide 610, as illustrated in FIG. 9. Again, it is desirable that the value of the angle $\theta_1$ be about 120°. However, the angle $\theta_1$ can be adjusted to any suitable value, depending upon the particular standard, use or application, for example.

Also, similar to the discussion of the pole vault box 100, the lip 616 is positioned at the front edge 606 of the base pan 604 and extends inwardly towards the pole slide 610 in a downward direction away from the front edge 606 of the base pan 604. The lip 616 slopes inwardly towards the pole slide 610 at an angle $\theta_2$ that is formed by an axis y passing through the lip 616 and by the pole slide 610. The value of the angle $\theta_2$ can be any value less than 90° in order to minimize the lip 616 possibly interfering with the vaulting pole during the pole planting stage. It is desirable that the value of the angle $\theta_2$ be in the range of about 70° to about 80°, for example.

Also, as discussed in relation to the pole vault box 100, the outer lower edge 616*a* of the lip 616 is adaptable to be inserted into the runway 102 and can be recessed, for example. In an embodiment, the pole vault box 100 and/or 600 can be recessed into the runway 102 so that none of the top edges are exposed to the surface. By this construction, the user likely will initially fall on the surrounding surface instead of the pole vault box, such as during accidental breakage of the pole, presuming that area surrounding the pole vault box 100, 600 is cushioned, for example. Further, the lip 616 can have an adhesive, such as a suitable glue, epoxy or other fastening material, on a surface of the lip adjacent to the runway, such as can provide a glue edge lip or a glue down lip, for example, to assist in anchoring the lip 616 at, into or below the runway, such as the runway 102, for example.

Further, similar to the pole vault box 100, the lower region 622*a* of the stop board 622 is positioned at an angle $\theta_3$ so as to extend outwardly in relation to the rotational ledge 620 of the end plate 618. Again, the value of the angle $\theta_3$ is in a range of about 105° to about 115°, for example.

Also, similar to the pole vault box 100, the upper region 622*b* of the stop board 622 is adjacent to the lower region 622*a* and has a shape that curves away from the lower region 622*a*, such as at a radius of curvature R, such as illustrated in FIGS. 8A and 8B. The curvature and the radius of curvature R of the upper region 622*b* can be structured of a suitable shape and suitable radius of curvature R, depending on a particular standard, use or application. The radius of curvature R can be structured to provide for a suitable degree curve of the upper region 622*b*, such as can depend upon a particular standard, use or application, such as a 5 degree curve or curvature, for example.

Figure 11A:
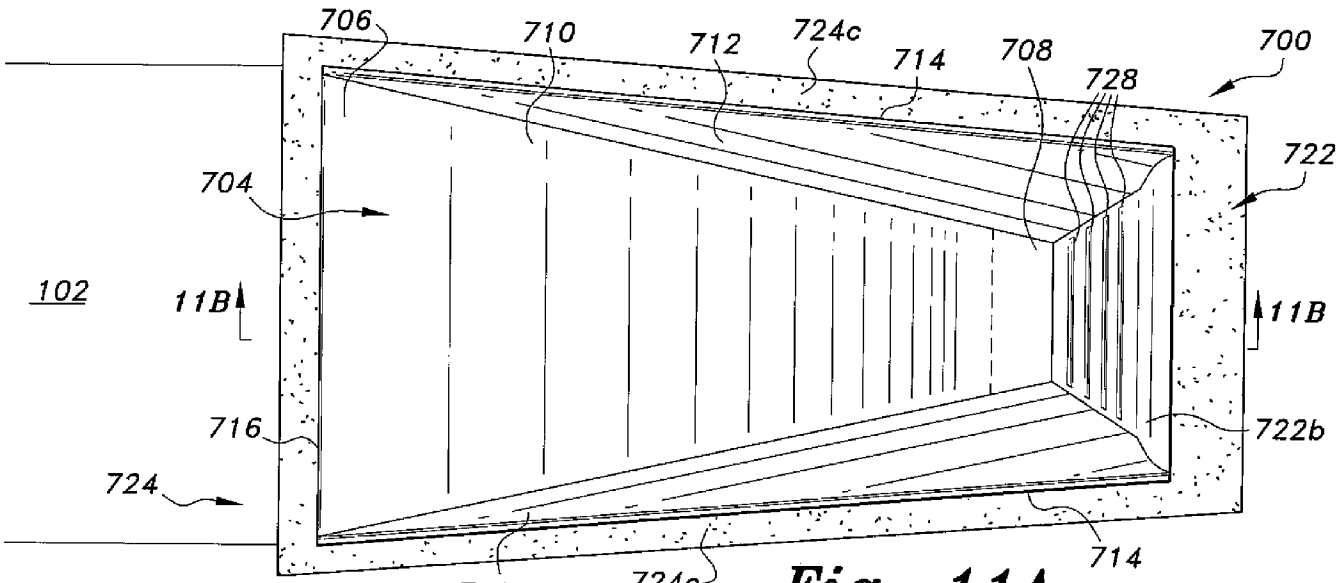
FIG. 11A is a top view of another embodiment of a pole vault box according to the present invention.
Figure 11B:
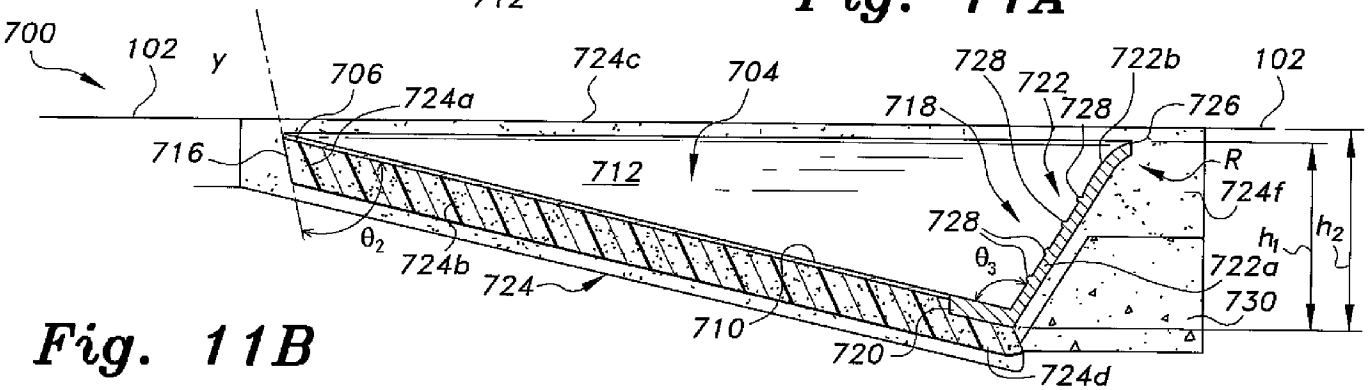
FIG. 11B is a side sectional view of the pole vault box shown in FIG. 11A.

Another embodiment of a padded pole vault box 700 is shown in FIGS. 11A and 11B. In this embodiment, the pole vault box 700 is constructed so as to provide padding around a substantial portion of the pole vault box 700 and desirably leave no top edge of the stiffer portions of the pole vault box 700 exposed. This type of construction provides another level of protection for a falling body by having the resilient material of the padding be the first structure impacted rather than the comparatively stiffer structure of the walls of the pole vault box 700.

As shown in FIGS. 11A and 11B, the padded pole vault box 700 is substantially similar to the pole vault box 100 or the pole vault box 600. Also, unless otherwise described or indicated, the components included in the pole vault box 700, as discussed and as illustrated in FIGS. 11A-11B, are similar to and correspond to those included in the pole vault box 100, described or illustrated in FIGS. 1-5, or to those included in the pole vault box 600 as described or illustrated in FIGS. 6-9, and can have a same or similar structure, shape and function and can be formed of same or similar materials or compositions, as those corresponding components discussed and described with respect to the pole vault box 100 or the pole vault box 600. As such, similar reference numbers in the "700" series have been used to designate similar features, and the following description will mostly relate to the differences thereof.

The padded pole vault box 700 includes an outer layer of padded material 724 surrounding the walls of the pole vault box 700, such as a pole slide 710, sidewalls 712, and an end plate 718, the end plate including a rotational ledge 720 and a stop board 722. When assembled, the padded material 724 can be disposed flush or a predetermined distance above the surface of the runway 102. In some instances, at least the padded material 724 in front of the pole vault box 700 is desirably flush so as to minimize risks of accidents from the pole catching on the padded material 724 rather than correctly traveling down the pole slide 710 during a pole vault attempt. Additionally, the front face of the padded material 724 in front of the pole vault box 700 is desirably fixed to the runway 102 via adhesives or fasteners so as can assist in preventing any undesirable movement of the pole vault box 700 within the cavity in which the pole vault box 700 is mounted.

To facilitate a cushioned fall, it is desirable that at least the sidewalls 712 of the pole vault box 700 can be shortened, such as relative to the sidewalls of a typical pole vault box, so that the top edge thereof is disposed below the surface of the runway 102 when installed thereon. Each shorter sidewall 712 can also be provided with a flared end 714 so that the flared end 714 can overlap or be positioned in conjunction with the side padding 724*c*. Either construction can provide some padded material 724*c* extending past the top edge of the respective sidewall 712 so as to cushion any impact thereon. The height difference that the padded material 724*c* extends above the sidewalls 712 can be seen in FIG. 11B where $h_1$ substantially corresponds to the height of the sidewalls 712 and represents the height to which the sidewalls 712 extend from a horizontal reference located at a juncture of the rotational ledge 720 and the stop board 722 and $h_2$ represents the height to which the padded material 724*c* extends from the horizontal reference, the height $h_2$ being greater than the height $h_1$. Also, as illustrated in FIG. 11B, the padded material 724 covers a base pan 704 and covers the end plate 718, the base pan 704 and the end plate 718 extending from the horizontal reference to a given height substantially corresponding to the height $h_1$, the padded material 724 adjacent the base pan 704 and the end plate 718 having a height substantially corresponding to the height $h_2$ greater than the given height, for example.

The front of the pole vault box 700 can be similarly configured as the pole vault box 100 or the pole vault box 600 except without the lip. As best seen in FIG. 11B, the front edge 706 can be formed adjacent a corresponding padded material 724*a* and/or padded material 724*b*. The padded material 724*b* can be constructed from the same material as the padded material 724 so as to form a uniform resilient covering around the walls of the pole vault box 700. Additionally, the padded material 724*b* can be provided as a separate layer constructed from resilient material with more or less resiliency than the padded material 724. By this construction, the cushioning afforded by the bottom of the pole vault box 700 can vary throughout the impact process, the variance depending on the resiliencies of the padded material 724 and the padded material 724*b*. When provided as a separate layer, at least the front portion or face of the padded material 724*b* can be affixed to the surrounding padded material 724 with adhesives, fasteners, and the like.

As with the sidewalls 712 and the front edge 706 of the pole slide 710, the end plate 718 can also be dimensioned so as to be disposed below the surface level of the runway 102. In all other respects, the end plate 718 is constructed substantially the same as the end plates 618 and 118, and includes the stop board 722, a flared edge 726, and ribbed surface 728. As best seen in FIG. 11B, the end plate 718 extends to a height generally below the height of the surrounding padded material 724 as represented by the greater height $h_2$ compared to the lesser height $h_1$. This construction, like the above, assists in insuring that the surrounding padded material 724 cushions the initial impact. The flared edge 726 can also allow the pole to bend naturally without presenting a relatively sharp edge or corner that can potentially erode or rub against the pole and cause premature breakage.

Also, it should be noted that whatever material is selected for the base pan 704 or the pole slide 710 or the plurality of opposing sidewalls 712, that the material be sufficiently rigid and robust enough to withstand the force generated from the vaulting pole striking and sliding down the pole vault box 700 yet flexible so as to absorb the impacts to a degree. The end plate 718 is desirably constructed from a relatively stiffer material compared to the relatively flexible material used to form the base pan 704 or at least the sidewalls 712 of the base pan 704, since the end plate 718 experiences a substantial amount of impacts during normal use. Thus, the end plate 718 should be relatively stiffer, robust and structurally sound in order to accommodate such impact forces.

The pole vault box 700 also includes a reinforcement feature that increases the life of the end plate 718 through repeated use. The end plate 718 of a pole vault box is a structural element that experiences the most amount of wear and impact forces during normal use. The end plate 718 is the part where the pole impacts and plants during a vaulting attempt. As a result, the end plate 718 can wear and deform faster than desired. To increase longevity and durability of the end plate 718, the pole vault box 700 can include an elongate, concrete reinforcement block 730 disposed behind the end plate 718. The block 730 is desirably shaped so that one face thereof conforms to the slanted or sloped disposition of the end plate 718. This provides a relatively flat face, the same generally flat face as the back of the end plate 718, which can buttress the end plate 718 in a relatively wide area. It is desirable that the block 730 covers at least the lower half of the end plate 718, since this is the area that experiences the most amount of impacts. Thus, the block 730 desirably spans at least the width of the end plate 718, for example.

In an embodiment, a relatively small layer of the padded material 724*f* is interposed between the end plate 718 and the concrete reinforcement block 730. This configuration can permit easier distribution of forces in the vertical direction during impacts on the end plate 718 while the block 730 remains steadfast to lateral forces. In other words, the interposed layer of padded material 724*f* can facilitate a relatively more easier or efficient dampening of the impact forces. It is also contemplated that the block 730 can be placed in direct contact with the back of the end plate 718. However, the dampening effect typically will be less.

Figure 10:
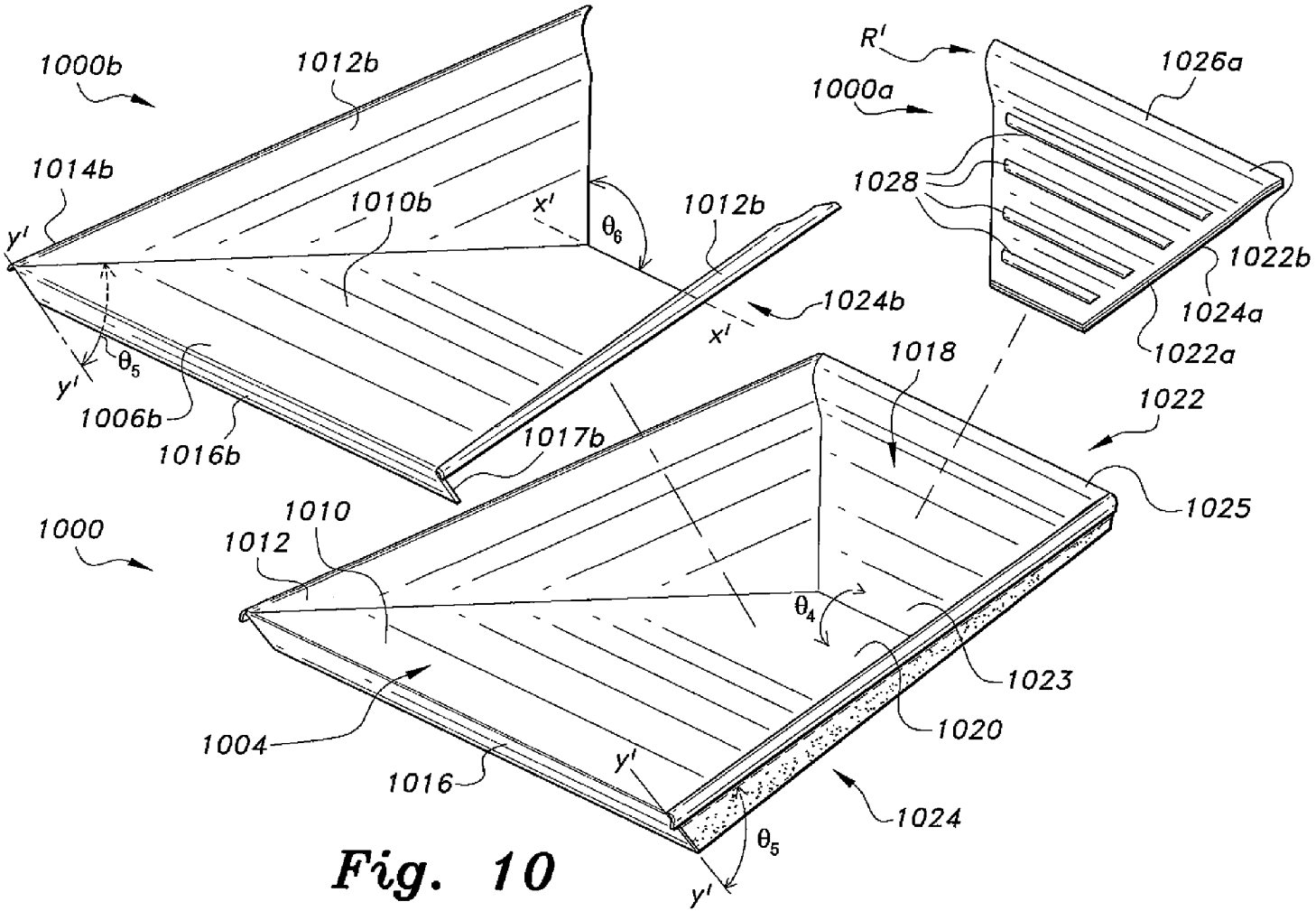
FIG. 10 is an exploded perspective view of an embodiment of a pole vault box illustrating a first retro piece as can be applied to a stop board and a second retro piece as can be applied to a pole slide, a lip, and sidewalls of a pole vault box according to the present invention.

Referring to FIG. 10, an exploded perspective view of an embodiment of a pole vault box 1000 is illustrated. Pole vault box 1000 is similar to the pole vault boxes 100, 600 or 700, but pole vault box 1000 can also include a first retro piece 1000*a* as can be applied to or over or replace a stop board 1022, and a second retro piece 1000*b* as can be applied to or over or replace a pole slide 1010, a lip 1016 and a plurality of opposing sidewalls 1012 of a base pan 1004, for example, are illustrated.

Also, the components included in the pole vault box 1000, as discussed and as illustrated in FIG. 10, are similar to and correspond to those included in the pole vault box 100, described or illustrated in FIGS. 1-5, are similar to and correspond to those included in the pole vault box 600, described or illustrated in FIGS. 6-9, and are similar to and correspond to those included in the pole vault box 700, described or illustrated in FIGS. 11A-11B. The components of the pole vault box 1000 can have a same or similar structure, size, shape and function and can be formed of same or similar materials or compositions, as those corresponding components discussed and described with respect to the pole vault boxes 100, 600 or 700.

Further, either or both of the first retro piece 1000*a* and the second retro piece 1000*b* can provide a replacement system or a component system for an existing pole vault box, such as to be applied to or over or replace one or more corresponding components of an existing pole vault box, such as for the pole vault boxes 100, 600, 700 and 1000.

Additionally, the first retro piece 1000*a* and the second retro piece 1000*b* can be placed together as a component system, such as by being fixed or removably secured, so as to form an entire pole vault box, that, when combined, is similar to the pole vault boxes 100, 600, 700 and 1000, such as by suitable mechanical fasteners, a tongue in groove or interlocking arrangement, a pressure fit, a suitable glue, sealant or adhesive, or a combination thereof, for example. In this regard, the first retro piece 1000*a* can correspond to all or part of an end plate, such as the end plates 118, 618, 718 and 1018. Also, the first retro piece 1000*a* and the second retro piece 1000*b* can include a padded material, as described, that, when combined, can form an entire pole vault box as can include all or part thereof with a padded material.

Also, in a replacement system or a component system as can include one or more of the pole vault box 1000, the first retro piece 1000*a* and the second retro piece 1000*b*, the end plate, such as end plate 1018, can act as an anchor of the pole vault box. And the base pan 1004 also includes the end plate 1018 as can be fixed or removably secured to the base pan, such as the base pan 1004, such that the end plate 1018 and the first retro piece 1000*a* can be fixed to or removably secured from the combination of the base pan 1004 and the second retro piece 1000*b*, for example.

The first retro piece 1000*a* and the second retro piece 1000*b* can be formed as separate pieces from the pole vault box 1000, but, as discussed, are available as additions to the pole vault box 1000. For example, the first retro piece 1000*a* can be applied to and over or replace a stop board 1022, such as applied to or over or replace the stop board 122 of pole vault box 100 or applied to or over or replace the stop board 622 of pole vault box 600. The first retro piece 1000*a* can change or adjust, such as increase, an angle $\theta_4$ between a rotational ledge 1020, such as the rotational ledge 120 of the pole vault box 100 or the rotational ledge 620 of the pole vault box 600, and the stop board 1022, such as the stop board 122 or the stop board 622. Also, the first retro piece 1000*a* can be used to cover or replace an existing, worn or damaged stop board 1022, such as to cover or replace an existing, worn or damaged stop board 122 of the pole vault box 100 or to cover or replace an existing, worn or damaged stop board 622 of the pole vault box 600, for example. Further, the first retro piece 1000*a* can include a padded material 1024*a* as can be used to cover and pad an existing stop board 1022, such as to cover and pad an existing stop board 122 of the pole vault box 100 or to cover and pad an existing stop board 622 of the pole vault box 600, for example.

Also, the first retro piece 1000*a* includes a lower region 1022*a* and an upper region 1022*b*, similar to the lower region 122*a* and the upper region 122*b* of the stop board 122 of the pole vault box 100 or similar to the lower region 622*a* and the upper region 622*b* of the stop board 622 of the pole vault box 600. It is desirable that the lower region 1022*a* of the first retro piece 1000*a* accounts for about 70% of the total size of first retro piece 1000*a* and that upper region 1022*b* accounts for about the remaining 30% of the total size of the first retro piece 1000*a*. It should be noted that the lower region 1022*a* and the upper region 1022*b* can vary in size, such as 60% of the first retro piece 1000*a* is the lower region 1022*a* and 40% of the first retro piece 1000*a* is the upper region 1022*b*, for example, such as depending on a particular standard, use, or application.

Also, the lower region 1022*a* of first retro piece 1000*a* has a relatively straight, generally linear shape. The upper region 1022*b* of the first retro piece 1000*a* is adjacent to the lower region 1022*a* and has a shape that curves away from the lower region 1022*a*, such as at a radius of curvature R'. The curvature and the radius of curvature R' of the upper region 1022*b* can be structured of a suitable shape and suitable radius of curvature R', depending on a particular standard, use or application, such as can correspond to the radius of curvature of an upper region 1025 of the stop board 1022, such as can be similar to the radius of curvature R of the upper region 122*b* of the stop board 122 of the pole vault box 100, and such as can such as can be similar to the radius of curvature R of the upper region 622*b* of the stop board 622 of the pole vault box 600. By having the first retro piece 1000*a* in a relatively straight, generally linear orientation in the lower region 1022*a* and in a generally curved orientation for the upper region 1022*b*, the first retro piece 1000*a* assumes a generally curvilinear shape, as illustrated in FIG. 10, for example.

Further, the upper region 1022*b* of the first retro piece 1000*a* can have a flared edge 1026*a*. The flared edge 1026*a* can be of various suitable shapes, such as rounded, curved, flat, or any other desirable shape, that can assist in minimizing injury to the pole vaulter, as discussed with respect to the flared edge 126 of the stop board 122 of the pole vault box 100 or with respect to the flared edge 626 of the stop board 622 of the pole vault box 600.

The first retro piece 1000*a* can have a same or similar structure, size, shape and function and can be formed of same or similar materials or compositions, as those corresponding to the stop board 1022, and as those corresponding components as discussed and described with respect to the stop board 122 of the pole vault box 100, the stop board 622 of the pole vault box 600 or the stop board 722 of the pole vault box 700.

For example, the first retro piece 1000*a* can be made from a same, compatible or suitable material as the stop board 1022. For example, if the first retro piece 1000*a* is attached to or placed over or replaces the stop board 1022 that is made from an aluminum material, then the first retro piece 1000*a* can be made from an aluminum material, as well. Additionally, the first retro piece 1000*a* can be respectively made from other suitable or compatible materials, such as from a high density UV plastic or a light weight steel material, among other robust materials, for example, such as depending on a particular standard, use or application.

When the first retro piece 1000*a* is applied to or over or replaces the stop board 1022, the lower region 1022*a* of the first retro piece 1000*a* is at the angle $\theta_4$ with respect to an interior surface of the rotational ledge 1020, the angle $\theta_4$ being measured between an interior surface of the lower region 1022*a* of the first retro piece 1000*a* and the interior surface of the rotational ledge 1020, as illustrated in FIG. 10, and the first retro piece 1000*a* is positioned at the angle $\theta_4$ so as to extend outwardly in relation to the rotational ledge 1020 of the end plate 1018, for example. The value of the angle $\theta_4$ can be the same as or a different value than the angle $\theta_3$, such as the angle $\theta_4$ can have an increased value relative to the angle $\theta_3$, depending upon a particular standard, use or application. The value of angle $\theta_4$ can be in a range of about 105° to about 115°, for example.

The first retro piece 1000*a*, when applied to or over or replaces the stop board 1022, can be fixed or removably secured to the stop board 1022 by suitable mechanical fasteners, a tongue in groove or interlocking arrangement, a pressure fit, a suitable glue, sealant or adhesive, or a combination thereof, for example. Also, when the first retro piece 1000*a* replaces the stop board 1022, the replacement can include physically removing the stop board 1022 from the pole vault box 1000, such as cutting out or detaching the stop board 1022 and replacing it with the first retro piece 1000*a*.

Further, the first retro piece 1000*a* can have a padded material 1024*a*, similar to the padded material 124 of the pole vault box 100 or similar to the padded material 624 of the pole vault box 600, on all or a portion of the underside/exterior surface of the first retro piece 1000*a*, such as can provide for additional shock attenuation. Also, the interior surface of first retro piece 1000*a* can have a ribbed surface 1028 as, for example, ripples or ridges, such as the ribbed surface 128 on the interior surface of the stop board 122 of the pole vault box 100 or the ribbed surface 628 on the interior surface of the stop board 622 of the pole vault box 600.

As to the second retro piece 1000*b*, the second retro piece 1000*b* includes a pole slide 1010*b*, corresponding to the pole slide 1010, such as the pole slide 110 of the base pan 104 of the pole vault box 100 or the pole slide 610 of the base pan 604 of the pole vault box 600. Also, the second retro piece 1000*b* can include a lip 1016*b*, such as the lip 116 of the pole vault box 100 or the lip 616 of the pole vault box 600. Also, when the second retro piece 1000*b* is used in conjunction with the pole vault box 700, the lip 1016*b* is typically not included on the second retro piece 1000*b*, for example. Further, the second retro piece 1000*b* includes a plurality of opposing sidewalls 1012*b*, such as the plurality of opposing sidewalls 112 of pole vault box 100 or the plurality of opposing sidewalls 612 of the pole vault box 600.

The second retro piece 1000*b* including pole slide 1010*b*, the lip 1016*b*, and the plurality of opposing sidewalls 1012*b*, can be applied to or over or replace corresponding components of the pole vault box 1000, such as including the pole slide 1010, a lip 1016 as can be included with the pole slide 1010, and a plurality of opposing sidewalls 1012 as can be included with a base pan 1004 of the pole vault box 1000, such as can be applied to or over or replace the pole slide 110, the lip 116 and sidewalls 112 of the base pan 104 of the pole vault box 100 or can be applied to or over or replace the pole slide 610, the lip 616 and the sidewalls 612 of base pan 604 of the pole vault box 600. The second retro piece 1000*b* can therefore be used to cover or replace an existing, worn or damaged pole slide 1010, a lip 1016 or a plurality of opposing sidewalls 1012 associated with the base pan 1004, for example.

In the second retro piece 1000*b*, the lip 1016*b* extends inwardly towards the pole slide 1010*b* of the second retro piece 1000*b* in a downward direction away from the front edge 1006*b* of the second retro piece 1000*b*. The lip 1016*b* slopes inwardly towards the pole slide 1010*b* at an angle that is formed by an axis passing through the lip 1016*b* and by the pole slide 1010*b* for the pole vault box 1000. In this regard, the lip 1016*b* slopes at an angle $\theta_5$ that is formed by an axis y' that passes through the lip 1016*b* and by the pole slide 1010*b*. The angle $\theta_5$ is measured from a bottom surface of pole slide 1010*b* in an outward direction to the y' axis, such as shown on pole vault box 1000 and on the second retro piece 1000*b* illustrated in FIG. 10.

Similar to the value of the angle $\theta_2$ for pole vault boxes 100 and 600, the value of the angle $\theta_5$ can be any value less than 90° in order to minimize the lip 1016*b* from sticking straight out and possibly interfering with the vaulting pole during the pole planting stage. It is desirable that the value of the angle $\theta_5$ be in the range of about 70° to about 80°, for example.

Further, when the second retro piece 1000*b* is applied to or over or replaces the pole slide 1010 including the lip 1016 and plurality of opposing sidewalls 1012, the lip 1016*b* of the second retro piece 1000*b* is adapted for positioning into and below the surface of a runway, such as the runway 102 as illustrated in FIG. 1, for example. By inserting an outer lower edge 1017*b* of the lip 1016*b* into the runway, such as the runway 102, the outer lower edge 1017*b* of the lip 1016*b* will not be exposed onto the surface of the runway, thereby possibly reducing a risk of the tip of the vaulting pole catching against the outer lower edge 1017*b* of the lip 1016*b* as the vaulter is planting the vaulting pole.

It is desirable that the lip 1016*b* be recessed below the runway at a minimum depth of about 0.5 inches so as to reduce the possibility of the lip 1016*b* blocking a vaulting pole from correctly entering the front of the pole vault box 1000 or the pole slide 1010. Therefore, it is desirable that the outer lower edge 1017*b* of the lip 1016*b* is recessed below the surface of the runway at a depth of about 0.5 inch to about 1 inch, for example. Further, the lip 1016*b* can have an adhesive, such as a suitable glue, epoxy or other fastening material, on a surface of the lip adjacent to the runway, such as can provide a glue edge lip or a glue down lip, for example, to assist in anchoring the lip 1016*b* at, into or below the runway, such as the runway 102, for example.

The plurality of opposing sidewalls 1012*b* of the second retro piece 1000*b* extend from the pole slide 1010*b* in an upward direction and extend at an angle $\theta_6$ with respect to a horizontal axis x' that is in a horizontal relation with respect to the pole slide 1010*b*, such as illustrated in FIG. 10. The angle $\theta_6$ is measured from an interior surface of the pole slide 1010*b* to an interior surface of a corresponding sidewall 1012*b*, similar to the angle $\theta_1$ of pole vault boxes 100 and 600.

It is desirable that the angle $\theta_6$ be about 120°, similar to the angle $\theta_1$. However, the angle $\theta_6$ can be adjusted to any suitable value, as long as the plurality of opposing sidewalls 1012*b* do not interfere with the planting of the vaulting pole in the pole vault box 1000 and the angle $\theta_6$ meets a corresponding standard, use or application. Further, each of the plurality of opposing sidewalls 1012*b* can have a flared end 1014*b* to provide a contoured edge that can assist in further protecting an athlete if the athlete were to land onto the sidewall 1012*b*.

The second retro piece 1000*b*, when applied to or over or replaces the pole slide 1010, the lip 1016 and the plurality of opposing sidewalls 1012, can be fixed or removably secured to the pole slide 1010, the lip 1016 and the plurality of opposing sidewalls 1012 such as by suitable mechanical fasteners, a tongue in groove or interlocking arrangement, a pressure fit, a suitable glue, sealant or adhesive, or a combination thereof, for example. Also, when the second retro piece 1000*b* replaces the pole slide 1010, the lip 1016 and the plurality of opposing sidewalls 1012, the replacement can include physically removing the pole slide 1010, the lip 1016 and the plurality of opposing sidewalls 1012 from the pole vault box 1000.

Such removal can include, for example, cutting out or detaching the pole slide 1010 including the lip 1016 and the plurality of opposing sidewalls 1012 from the pole vault box 1000 and replacing the corresponding components with the second retro piece 1000*b*. Also, when the lip 1016*b* is not included on or is removed from the pole vault box 1000, the second retro piece 1000*b* can similarly not include the lip, as well as can be suitably sized to provide a pole vault box similar to the pole vault box 700, for example.

Therefore, the second retro piece 1000*b* can be used to cover or replace an existing, worn or damaged pole slide 1010 including the lip 1016 and the plurality of opposing sidewalls 1012, such as to cover or replace an existing, worn or damaged pole slide 110 including the lip 116 and plurality of opposing sidewalls 112 of the base pan 104 of the pole vault box 100 or to cover or replace an existing, worn or damaged pole slide 610 including the lip 616 and plurality of opposing sidewalls 612 of the base pan 604 of the pole vault box 600, for example.

The second retro piece 1000*b* can have a same or similar structure, size, shape and function and can be formed of same or similar materials or compositions, as those corresponding components discussed and described with respect to the pole slide 1010 including the lip 1016 and the plurality of opposing sidewalls 1012 of the base pan 1004 of the pole vault box 1000, such as the pole slide 110 including the lip 116 and the plurality of opposing sidewalls 112 of the base pan 104 of the pole vault box 100, the pole slide 610 including the lip 616 and the plurality of opposing sidewalls 612 of the base pan 604 of the pole vault box 600, or the pole slide 710 and the plurality of opposing sidewalls 712 of the base pan 704 of the pole vault box 700 but without a lip.

Further, the second retro piece 1000*b* can have a padded material 1024*b*, similar to a padded material 1024 on the pole vault box 1000 or similar to padded material 124 or the padded material 624, on all or a portion of the underside/exterior surface of the pole slide 1010*b* including on the underside/exterior surface of the lip 1016*b* and on the exterior surface of the plurality of opposing sidewalls 1012*b*, such as to provide for additional shock attenuation, for example.

Also, the second retro piece 1000*b* including the pole slide 1010*b*, the lip 1016*b* and the plurality of opposing sidewalls 1012*b* can be made from a same, compatible or suitable material as pole slide 1010 including the lip 1016 and the plurality of opposing sidewalls 1012. For example, if the second retro piece 1000*b* is attached to or placed over or replaces the pole slide 1010 including the lip 1016 and the plurality of opposing sidewalls 1012 that is made from an aluminum material, then the second retro piece 1000*b* including the pole slide 1010*b*, the lip 1016*b* and the plurality of opposing sidewalls 1012*b* can be made from an aluminum material, as well.

Additionally, the second retro piece 1000*b* can be respectively made from other suitable or compatible materials, such as from a high density UV plastic or a light weight steel material, among other robust materials, for example, such as depending on a particular standard, use or application. Also, the second retro piece 1000*b* including the pole slide 1010*b* and the lip 1016*b* and the plurality of opposing sidewalls 1012*b* can be made from a number of different materials, including wood, welded sheet steel, stainless steel, sheet or cast aluminum, fiberglass, or thermoplastic, among others, for example.

It should be noted that whatever material is selected for the base pan 1004 or the pole slide 1010 or the plurality of opposing sidewalls 1012 of the pole vault box 1000, or that whatever material is selected for the pole slide 1010*b* or the plurality of opposing sidewalls 1012*b* of the second retro piece 1000*b*, that the material be sufficiently rigid and robust enough to withstand the force generated from the vaulting pole striking and sliding down the pole vault box, such as the pole vault box 1000, yet flexible so as to absorb the impacts to a degree.

Also, the end plate 1018, as can include the rotational ledge 1020 and the stop board 1022, and the first retro piece 1000*a* are each desirably constructed from a relatively stiffer material compared to the relatively flexible material used to form the base pan 1004 or at least the sidewalls 1012 of the base pan 1004, or compared to the relatively flexible material used to form the pole slide 1010*b* or the plurality of opposing sidewalls 1012*b* of the second retro piece 1000*b*, since the end plate 1018 and the first retro piece 1000*a* experience a substantial amount of impacts during normal use. Thus, the end plate 1018 and the first retro piece 1000*a* should be relatively stiffer, robust and structurally sound in order to accommodate such impact forces.

Further, the first retro piece 1000*a* and the second retro piece 1000*b* can be formed to match or correspond to the dimensions of the corresponding existing pieces of the pole vault box 1000 that they will be respectively applied to, cover or replace. For example, if the stop board 1022 is approximately 6 inches wide at a lower region 1023 and approximately 16 inches wide at an upper region 1025, the first retro piece 1000*a* can have similar corresponding dimensions to those approximate dimensions.

It is to be understood that the present invention is not limited to the embodiments described above, but encompasses any and all embodiments within the scope of the following claims.

I claim:

1. A padded pole vault box adapted to provide increased shock attentuation, comprising:

a base pan adapted to be mounted in a pole vaulting runway, the base pan having a front edge and an opposing rear edge, the base pan having a pole slide descending in a downward direction from the front edge towards the opposing rear edge, the base pan having a plurality of opposing sidewalls that extend from the front edge to the opposing rear edge in an upward direction from the pole slide, the plurality of opposing sidewalls extending at an angle with respect to a horizontal axis that is in horizontal relation with respect to the pole slide;

an end plate positioned at the rear edge of the base pan, the end plate including a rotational ledge and a stop board, the rotational ledge being positioned in conjunction with the pole slide, and the stop board being positioned in conjunction with the opposing sidewalls and the rear edge of the base pan, the stop board including a lower region adjacent to the rotational ledge and an upper region adjacent the lower region, the upper region of the stop board curving away from the lower region of the stop board, and the lower region of the stop board being positioned at an angle so as to extend outwardly in relation to the rotational ledge of the end plate;

padded material covering at least a major portion of an exterior of the base pan and the end plate, the padded material adapted to cushion impact forces thereon; and a lip positioned at the front edge of the pole slide, the lip extending downwardly towards the bottom of the pole slide away from the front edge and sloping inwardly towards the pole slide at an acute angle that is formed by an axis passim through the lip and by the pole slide.

2. The padded pole vault box according to claim 1, wherein the base pan and the end plate are integrally formed.

3. The padded pole vault box according to claim 1, wherein the plurality of sidewalls each extend at an obtuse angle with respect to the horizontal axis in relation to the pole slide.

4. The padded pole vault box according to claim 3, further comprising:

a flared end on top of each sidewall.

5. The padded pole vault box according to claim 1, wherein the angle at which the lower region of the stop board is positioned in relation to the rotational ledge of the end plate is in a range of about 105 degrees to about 115 degrees.

6. The padded pole vault box according to claim 1, wherein the end plate is removably securable to the rear edge of the base pan.

7. The padded pole vault box according to claim 1, wherein at least a part of an interior surface of the stop board of the end plate includes a ribbed surface.

8. The padded pole vault box according to claim 1, further comprising:

at least one retro piece separate from the pole vault box, the at least one retro piece structured to correspond to the base pan or the end plate, the at least one retro piece adapted to cover or replace an existing base pan or end plate.

9. The padded pole vault box according to claim 1, wherein the padded material covers the sidewalls, each sidewall having a height, padded material adjacent each sidewall having a height greater than the height of the corresponding sidewall.

10. The padded pole vault box according to claim 1, wherein the padded material covers the base pan and the end plate, the base pan and the end plate extending from a horizontal reference to a given height, the padded material adjacent the base pan and the end plate having a height greater than the given height, the horizontal reference being located at a juncture of the rotational ledge and the stop board.

11. The padded pole vault box according to claim 1, further comprising:

a reinforcement block disposed behind the end plate, the reinforcement block buttressing at least the lower region of the end plate against repeated impacts.

12. The padded pole vault box according to claim 1, wherein at least the plurality of sidewalls is constructed from flexible material, the end plate being constructed from stiffer material compared to the sidewalls to durably withstand impacts thereon.

13. A component system for a pole vault box, the pole vault box including a base pan having a pole slide and having a plurality of opposing sidewalls, and an end plate positioned at a rear edge of the base pan, the end plate including a rotational ledge and a stop board, the component system comprising:

a first retro piece structured to correspond to at least the stop board of the end plate of the pole vault box, the first retro piece including a lower region and an upper region adjacent the lower region, the upper region of the first retro piece curving away from the lower region of the first retro piece, the lower region being positioned at an angle so as to extend outwardly in relation to the rotational ledge of the end plate; and a second retro piece structured to correspond to the pole slide and the plurality of opposing sidewalls of the pole vault box, the second retro piece including the pole slide and the opposing sidewalls, a front edge of the second retro piece corresponding to a front edge of the base pan of the pole vault box, wherein the first retro piece is structured to cover or replace at least the stop board of the end plate of the pole vault box, the second retro piece is structured to cover or replace the pole slide and the opposing sidewalls of the pole vault box, or the first retro piece and the second retro piece are structured to be removably securable so as to be combined with or to form the pole vault box.

14. A component system for a pole vault box according to claim 13, wherein the pole vault box further includes a lip positioned at the front edge of the base pan and extending inwardly towards the pole slide in a downward direction away from the front edge of the base pan and sloping inwardly towards the pole slide at an angle that is formed by an axis passing through the lip and by the pole slide, the second retro piece is structured to correspond to the pole slide, the lip and the plurality of opposing sidewalls of the pole vault box, the second retro piece including the pole slide, the lip and the opposing sidewalls, the lip of the second retro piece extending from a front edge of the second retro piece in a downward direction away from the front edge of the second retro piece and sloping inwardly towards the pole slide at an angle that is formed by an axis passing through the lip and by the pole slide, and the second retro piece is structured to cover or replace the pole slide, the lip and the opposing sidewalls of the pole vault box.

15. A pole vault box, comprising:

a base pan adapted to be mounted on a pole vaulting runway, the base pan having a front edge and an opposing rear edge, the base pan having a pole slide descending in a downward direction from the front edge towards the opposing rear edge, the base pan having a plurality of opposing sidewalls that extend from the front edge to the opposing rear edge in an upward direction from the pole slide, the plurality of opposing sidewalls extending at an angle with respect to a horizontal axis that is in horizontal relation with respect to the pole slide;

a lip positioned at the front edge of the base pan, the lip extending inwardly towards the pole slide in a downward direction away from the front edge and sloping inwardly towards the pole slide at an angle that is formed by an axis passing through the lip and by the pole slide; and an end plate positioned at the rear edge of the base pan, the end plate including a rotational ledge and a stop board, the rotational ledge being positioned in conjunction with the pole slide, and the stop board being positioned in conjunction with the opposing sidewalls and the rear edge of the base pan, the stop board including a lower region adjacent to the rotational ledge and an upper region adjacent the lower region, the upper region of the stop board curving away from the lower region of the stop board, and the lower region of the stop board being positioned at an angle so as to extend outwardly in relation to the rotational ledge of the end plate.

16. The pole vault box according to claim 15, wherein the angle at which the lower region of the stop board is positioned in relation to the rotational ledge of the end plate in a range of about 105 degrees to about 115 degrees.

17. The pole vault box according to claim 16, further comprising:

a flared end on top of each sidewall, each flared end having a rounded shape.

18. The padded pole vault box according to claim 15, further comprising padded material on the base pan, lip and end plate of the pole vault box.

19. The padded pole vault box according to claim 1, wherein the acute angle is at least 70° and less than 90°.

20. The padded pole vault box according to claim 4, wherein each flared end has a rounded shape.

21. The padded pole vault box according to claim 4, wherein the padded material extends about the flared end.

22. The padded pole vault box according to claim 1, wherein the padded material is disposed directly under the rotational edge.

23. The padded pole vault box according to claim 11, wherein the padded material is disposed between the end plate and the reinforcement block.

* * * * *